US008584402B2

(12) United States Patent
Yamaguchi

(10) Patent No.: US 8,584,402 B2
(45) Date of Patent: Nov. 19, 2013

(54) DOOR OPENING/CLOSING SYSTEM AND CATCH THEREFOR

(75) Inventor: Koushi Yamaguchi, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 0 days.

(21) Appl. No.: 13/391,533

(22) PCT Filed: Aug. 18, 2010

(86) PCT No.: PCT/JP2010/063899

§ 371 (c)(1),
(2), (4) Date: Apr. 2, 2012

(87) PCT Pub. No.: WO2011/021630

PCT Pub. Date: Feb. 24, 2011

(65) Prior Publication Data

US 2012/0180395 A1 Jul. 19, 2012

(30) Foreign Application Priority Data

Aug. 20, 2009 (JP) ..... 2009-191100

(51) Int. Cl.
*E05F 15/06* (2006.01)

(52) U.S. Cl.
USPC ..... 49/379; 312/319.2

(58) Field of Classification Search
USPC ..... 49/275, 276, 379, 364; 312/319.2 X, 312/333, 405
See application file for complete search history.

(56) References Cited

U.S. PATENT DOCUMENTS

| | | | | |
|---|---|---|---|---|
| 2,553,023 | A * | 5/1951 | Walters | 49/276 |
| 4,133,142 | A * | 1/1979 | Dzus, Jr. | 49/379 |
| 4,897,961 | A * | 2/1990 | Shine | 49/141 |
| 7,506,474 | B2 * | 3/2009 | Yoshikawa et al. | 49/257 |
| 8,272,165 | B2 * | 9/2012 | Tomioka | 49/275 |
| 2004/0093799 | A1 * | 5/2004 | Yoshikawa et al. | 49/192 |

FOREIGN PATENT DOCUMENTS

| | | |
|---|---|---|
| JP | 2006-283460 | 10/2006 |
| JP | 2007-120140 | 5/2007 |
| JP | 2009-114823 | 5/2009 |

OTHER PUBLICATIONS

International Search Report, PCT/JP2010/063899, Oct. 19, 2010.

* cited by examiner

*Primary Examiner* — Jerry Redman
(74) *Attorney, Agent, or Firm* — Young & Thompson

(57) ABSTRACT

Provided is a door opening and closing system capable of returning to a return state where a catch and a retractable arm are engaged with each other even if the retractable arm is closed completely as a result of incorrect usage such as a prank. A catch has a catch base which is mounted on either one of the door and a frame and a catch shaft which is installed in the catch base slidable in an axial direction and engaged with a retractable arm. At a tip end of the catch shaft, a small-diameter part is provided as a step part. The step part of the catch shaft and the retractable arm are engaged with each other in a state where the retractable arm is further rotated in the closing direction after a main body part of the catch shaft and the retractable arm are engaged with each other.

15 Claims, 17 Drawing Sheets

A-A CROSS SECTION

DOOR OPENING/CLOSING SYSTEM AND CATCH THEREFOR

TECHNICAL FIELD

The present invention relates to a door opening and closing system and a catch therefor for assisting opening and closing of a door, such as a hinged door or a sliding door, of furniture or construction.

BACKGROUND ART

Furniture doors and construction doors can be classified into a hinged door type, a sliding door type or the like. The hinged door is a door that opens by rotating. The sliding door opens and closes by horizontally sliding on a frame composed of a head jamb and a doorsill.

In order to assist opening and closing of such a door, there is provided a door opening and closing system (for example, see Patent Literature PL1). The door opening and closing system has a catch which is mounted on either one of a door or a frame surrounding the door and a door opening and closing device which is mounted on the other of the door and the frame and cooperates with the catch.

In the door opening and closing device, a retractable arm is provided. The retractable arm is engaged with the catch. Before the door is closed, the retractable arm is in the open state. When the door gets closed, the retractable arm and the catch are engaged and the retractable arm rotates around an arm axis in the closing direction. Then, a force in the closing direction is exerted on the door. When the arm is rotated to the closed state, the door is in the closed state. On the other hand, when the door in the closed state gets open, the retractable arm rotates around the arm axis in the opening direction. When the door is opened a predetermined angle or more, engagement between the retractable arm and the catch is canceled to make the retractable arm in the open state.

CITATION LIST

Patent Literature

PL1: Japanese Patent Application Laid-Open No. 2009-114823

SUMMARY OF INVENTION

Technical Problem

When the retractable arm in the open state is brought into the closed state in error, due to a prank or the like, the retractable arm and the catch are not able to be engaged even if the door is closed.

Here, when the door is in the closed state, the retractable arm of the door opening and closing device still gives a force in the closing direction even after the door abuts to the frame, in order to prevent rattling of the door. That is, when the door is in the closed state, the retractable arm, itself, is not rotated to the completely closed state. Accordingly, if the retractable arm in the open state is brought into the closed state in error, due to a prank or the like, the retractable arm is rotated from the closed state, further in the closing direction to the completely closed state.

Then, the present invention aims to provide a door opening and closing system and a catch therefor, capable of allowing engagement between the catch and a retractable arm even when the retractable arm is completely closed as a result of incorrect usage, such as a prank.

Solution to Problem

In order to solve the above-mentioned problems, an aspect of the present invention is a door opening and closing system comprising: a catch which is mounted at either one of a door and a frame and a door opening and closing device which is mounted on an opposite one of the door and the frame and has a retractable arm that is engaged with the catch, in which, when the door gets closed, the retractable arm of the door opening and closing device is engaged with the catch and the retractable arm rotates about an arm axis to give the door a force in a closing direction, wherein the catch has a catch base which is mounted on the one of the door and the frame and a catch shaft which is installed in the catch base slidable in an axial direction and engaged with the retractable arm, the catch shaft has a main body part which is engageable with the retractable arm and a step part which is provided at a tip end of the main body part and engageable with the retractable arm, and the step part of the catch shaft and the retractable arm are engaged with each other in a state where the retractable arm is further rotated in the closing direction after the main body part of the catch shaft and the retractable arm are engaged with each other.

Another aspect of the present invention is a door opening and closing system comprising: a catch which is mounted at either one of a door and a frame and a door opening and closing device which is mounted on an opposite one of the door and the frame and has a retractable arm that is engaged with the catch, in which, when the door gets closed, the retractable arm of the door opening and closing device is engaged with the catch and the retractable arm rotates about an arm axis to give the door a force in a closing direction, wherein the catch has a catch base which is mounted on the one of the door and the frame and a catch shaft which is installed in the catch base slidable in an axial direction and engaged with the retractable arm, the catch shaft has a main body part which is engageable with the retractable arm and a step part which is provided at a tip end of the main body part and engageable with the retractable arm, and step difference is provided on an entire circumference of the catch shaft.

Yet another aspect of the present invention is a catch for a door opening and closing system which gives a door a force in a closing direction when the door gets closed, wherein the catch has a catch base which is mounted on either one of the door and a frame and a catch shaft which is installed in the catch base slidable in an axial direction and engaged with a retractable arm, the catch shaft has a main body part which is engageable with the retractable arm and a step part which is provided at a tip end of the main body part and engageable with the retractable arm, and step difference is provided on an entire circumference of the catch shaft.

Advantageous Effects of Invention

According to the present invention, the step part is provided at the tip end of the catch shaft, and the step part of the catch shaft and the retractable arm are engaged by further rotating the retractable arm in the closing direction after the retractable arm and the main body part of the catch shaft are engaged. With this structure, even if the retractable arm is completely closed as a result of incorrect usage such as a prank, it is possible to return to a return state where the catch and the retractable arm are engaged.

DESCRIPTION OF EMBODIMENTS

With reference to the attached drawings, a door opening and closing system according to an exemplary embodiment of the present invention will be described in detail below. The door opening and closing system of this embodiment is used to assist opening and closing of a door, and has a catch which mounted on a frame and a door opening and closing device which is mounted on the door and engaged with the catch.

Figure 1:
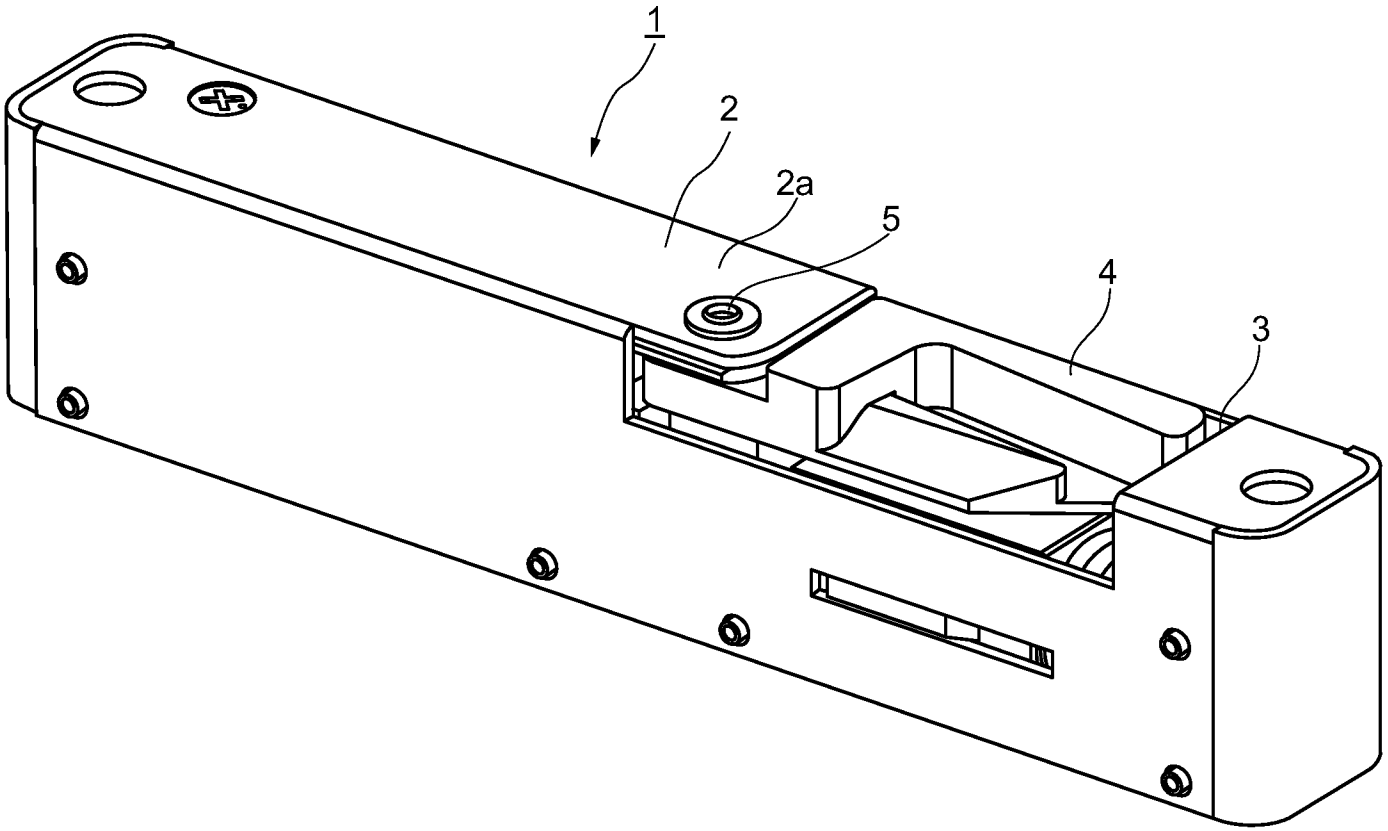
FIG. 1 is a perspective view illustrating appearance of a door opening and closing device of a door opening and closing system according to one embodiment of the present invention.

FIG. 1 is a perspective view illustrating appearance of the door opening and closing device. A body case 2 of the door opening and closing device is formed into an elongated rectangular solid. At a ceiling part 2*a* of the body case 2, a notch 3 is formed, in which a retractable arm 4 is arranged. The retractable arm 4 is rotatable in the horizontal plane around a retractable arm axis 5 and is exposed at the notch 3 (see FIG. 2).

Figure 2A:
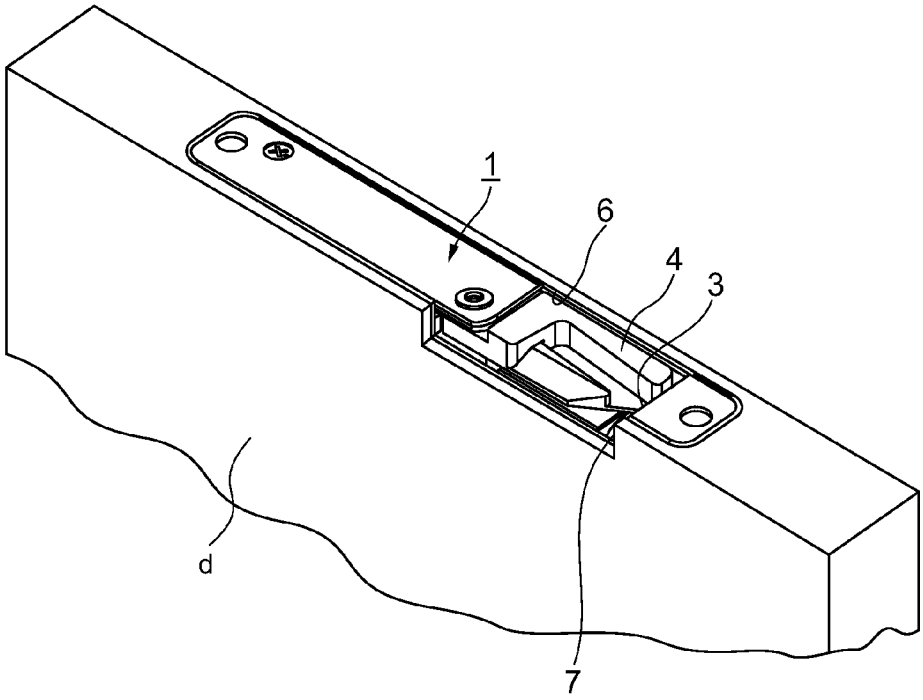
FIGS. 2(*a*) and 2(*b*) are perspective views illustrating appearance of the door opening and closing device mounted in a door (FIG. 2(*a*) illustrates a retractable arm in a closed state and FIG. 2(*b*) illustrates the retractable arm in a half-open state)
Figure 2B:
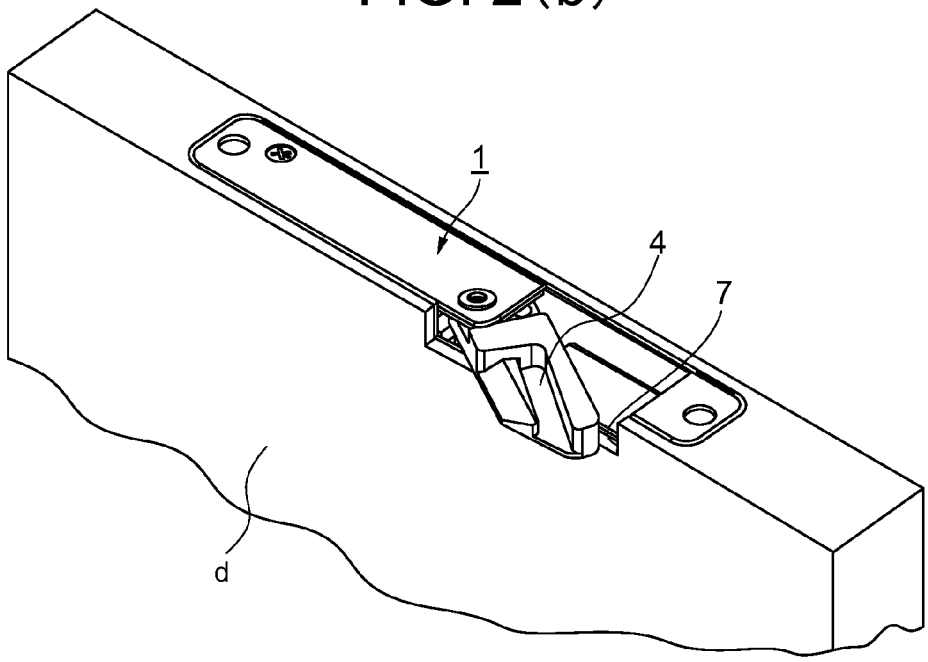

As illustrated in FIG. 2(*a*), in the upper surface of the door d, a box-shaped hole 6 is formed corresponding to the outer shape of the body case 2, and the door opening and closing device 1 is recessed in the hole 6. In the upper surface of the door d, a notch 7 is formed for exposing the retractable arm 4 at the position corresponding to the notch 3 of the body case 2. FIG. 2(*a*) illustrates the retractable arm 4 in the closed state. FIG. 2(*b*) illustrates the retractable arm 4 which is rotated from the closed state and exposed at the notch 7 of the door d.

Figure 3:
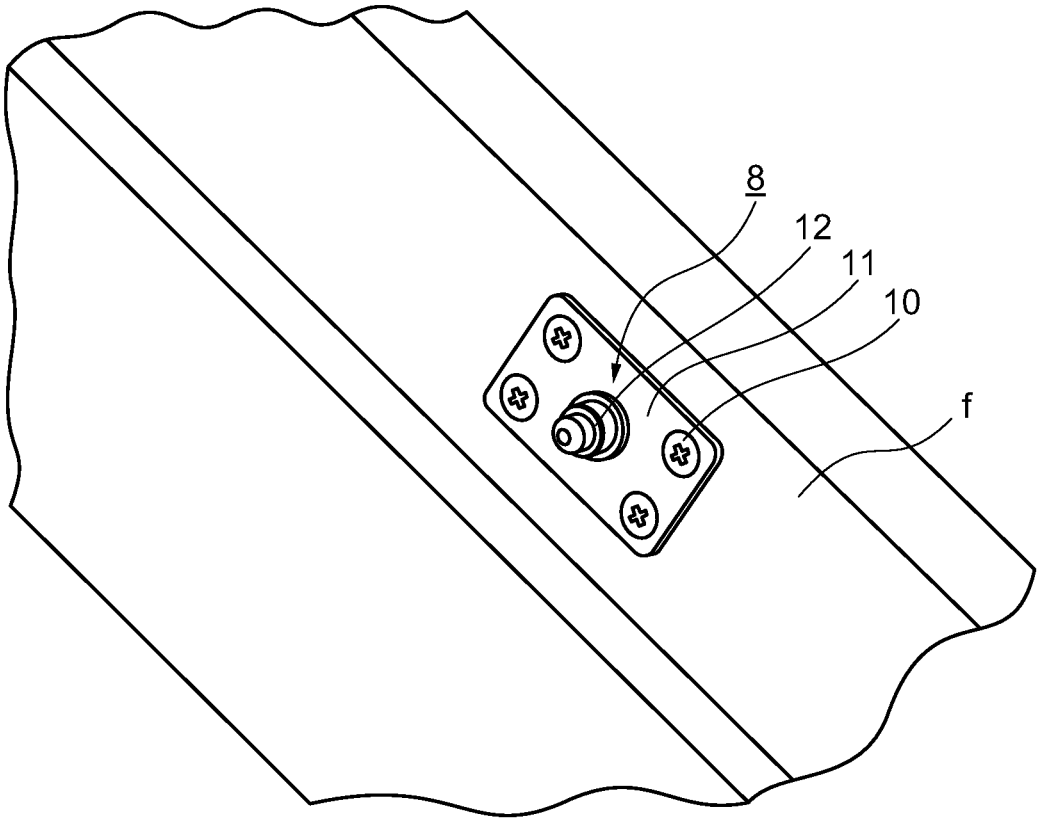
FIG. 3 is a perspective view illustrating a catch of the door opening and closing system.
Figure 4A:
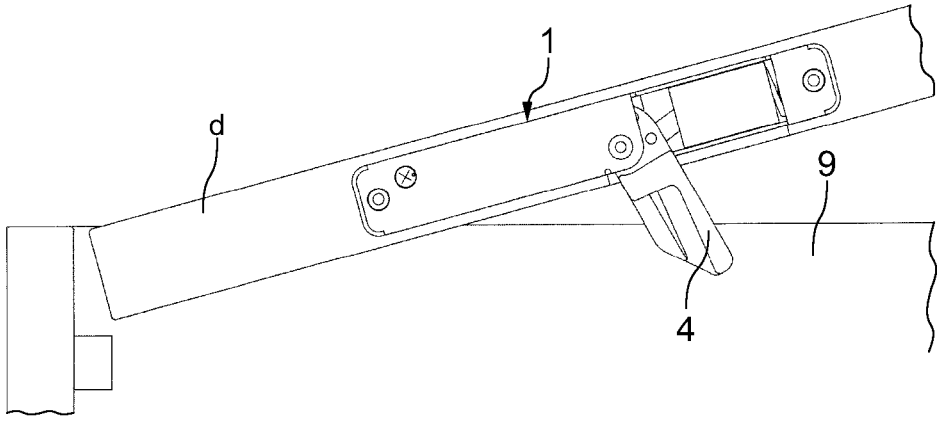
FIGS. 4(*a*) and 4(*b*) are views illustrating operations of the door opening and closing device when the door opens and closes (FIG. 4(*a*) illustrates the door being closed to catch a catch shaft by the retractable arm, and FIG. 4(*b*) illustrates the door closed)
Figure 4B:
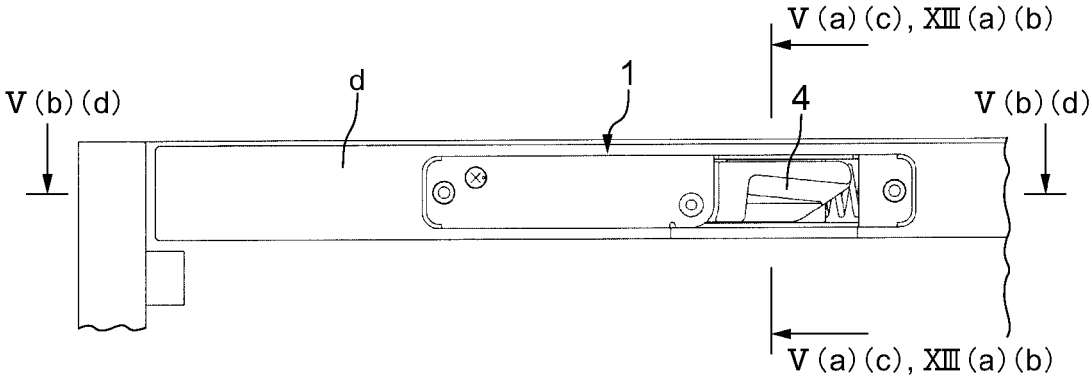
Figure 5A:
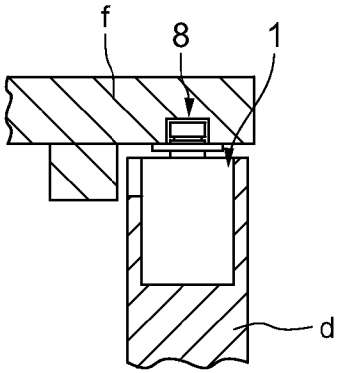
FIGS. 5(*a*) to 5(*d*) illustrate the door opening and closing device mounted in the door and the catch mounted in the frame (FIG. 5(*a*) is a side view, FIG. 5(*b*) is a front view, and FIGS. 5(*c*) and 5(*d*) are cross sectional views corresponding to FIGS. 5(*a*) and 5(*b*), respectively)
Figure 5B:
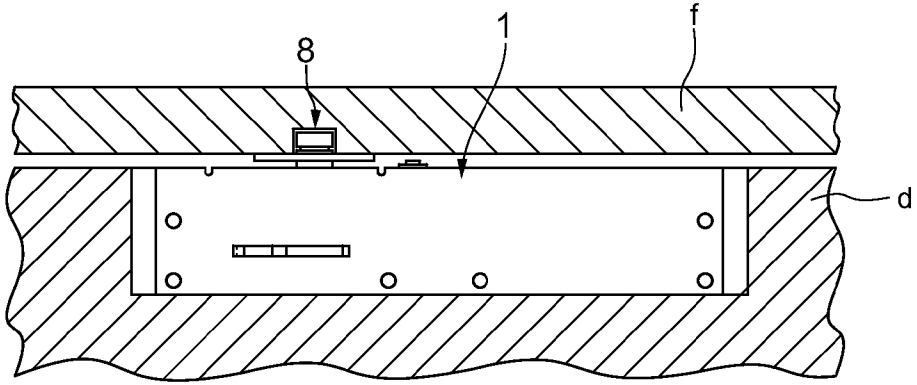
Figure 5C:
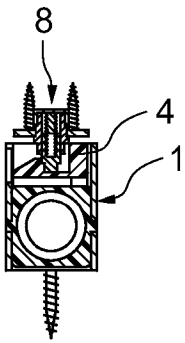
Figure 5D:
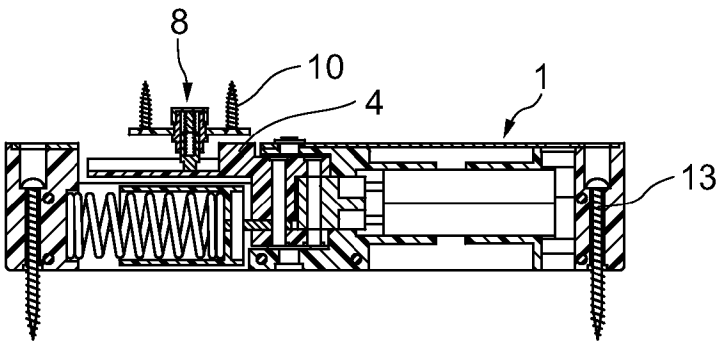

FIG. 3 illustrates a catch 8 that cooperates with the door opening and closing device 1. In FIG. 3, the catch 8 mounted on the upper-side frame f that surrounds the door d is seen from the bottom. The catch 8 has a catch base 11 that is fixed to the lower surface of the frame f by a countersunk screw 10 and a catch shaft 12 that projects from the catch base 11. As illustrated in FIG. 4(*a*), when the door d gets closed to a certain angle, the retractable arm 4 in the open state catches the catch shaft 12 of the catch 8. The retractable arm 4 tries rotating in the closing direction around the retractable arm axis 5 while the retractable arm 4 catches the catch shaft 12. Then, as illustrated in FIG. 4(*b*), the retractable arm 4 makes the door d in the completely closed state.

When a person goes out of a room and closes the door d lightly, sometimes the door d is not closed completely. Even when the door d is closed lightly, the door d can be closed completely by making the retractable arm 4 of the door opening and closing device 1 catch the catch shaft 12. And, when the open door d gets closed forcefully by wind or the like, the door opening and closing device 1 attenuates the impact on the door d and makes the door d get closed slowly. The door opening and closing device 1 acts to retract the door d and also to slow movement of the door d.

FIGS. 5(*a*) to 5(*d*) illustrate the door opening and closing device 1 and the catch 8 mounted on the door d and the frame f. FIG. 5(*a*) is a side view and FIG. 5(*b*) is a front view. FIGS. 5(*c*) and 5(*d*) are cross sectional views corresponding to FIGS. 5(*a*) and 5(*b*). The catch 8 is fixed to the frame f by the countersunk screw 10. The door opening and closing device 1 is fixed to the door d by a retaining screw 13. As illustrated in these figures, when the door d is in the closed state, the retractable arm 4 of the door opening and closing device 1 is also in the closed state. However, strictly speaking, when the door d is in the closed state, the retractable arm 4 of the door opening and closing device 1 is rotated slightly in the opening direction from the closed state. This is for the purpose of preventing rattling of the door d by applying an additional force in the closing direction to the door d in the closed state by the retractable arm 4 of the door opening and closing device 1.

Figure 6:
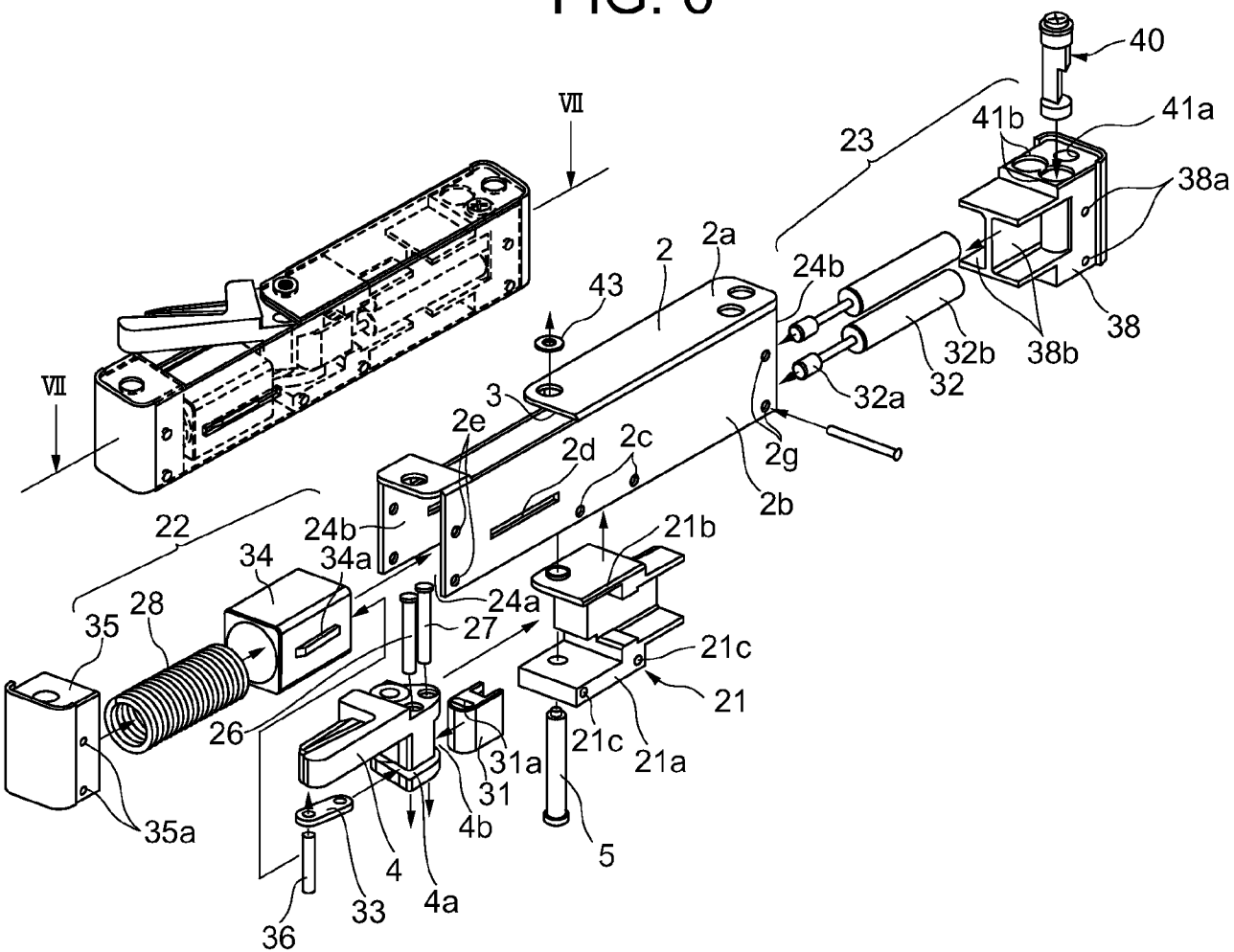
FIG. 6 is an exploded perspective view of the door opening and closing device.

FIG. 6 is an exploded perspective view of the door opening and closing device. The door opening and closing device 1 has the body case 2, an arm base 21 which is built in the body case 2, the retractable arm 4 supported rotatable by the arm base 21, a biasing mechanism 22 for giving a torque in the closing or opening direction to the retractable arm 4 and a damper mechanism 23 for attenuating impact when the retractable arm 4 gets closed. The arm base 21 is arranged at the center of the body case 2 in the longitudinal direction. The biasing mechanism 22 is arranged at one side of the body case 2 in the longitudinal direction and the damper mechanism 23 is arranged at the opposite side of the body case 2 to the biasing mechanism 22.

The outline structure of each part is described below. The body case 2 has the ceiling part 2*a*, and a pair of side wall parts 2*b*. The cross section of the body case 2 is U shaped. The body case 2 has a lower surface and end surfaces in the longitudinal direction, where openings 24*a*, 24*b* are formed for installation of the parts. Besides, in the ceiling part 2*a* of the body case 2, the notch 3 is formed for exposing the retractable arm 4. This body case 2 is manufactured by sheet metal processing of bending a thin plate.

The arm base 21 is arranged at the center of the body case 2 in the longitudinal direction and is a central part from structural and assembly points of view. The arm base 21 takes an approximately U shape and has first and second wall pars 21*a*, 21*b* facing each other. The retractable arm 4 is inserted into between the first and second wall parts 21*a*, 21*b* and the retractable arm axis 5 is made to pass through the arm base 21 and the retractable arm 4 from below, thereby connecting the retractable arm 4 to the arm base 21 rotatably. After the retractable arm 4 is connected to the arm base 21, the arm base 21 is inserted into and connected to the body case 2. Connection of the arm base 21 and body case 2 is made with use of a rivet, screw or the like. In the arm base 21 and the body case 2, mounting holes 21*c* and 2*c* are formed for connecting the arm base 21 to the body case 2.

Figure 7:
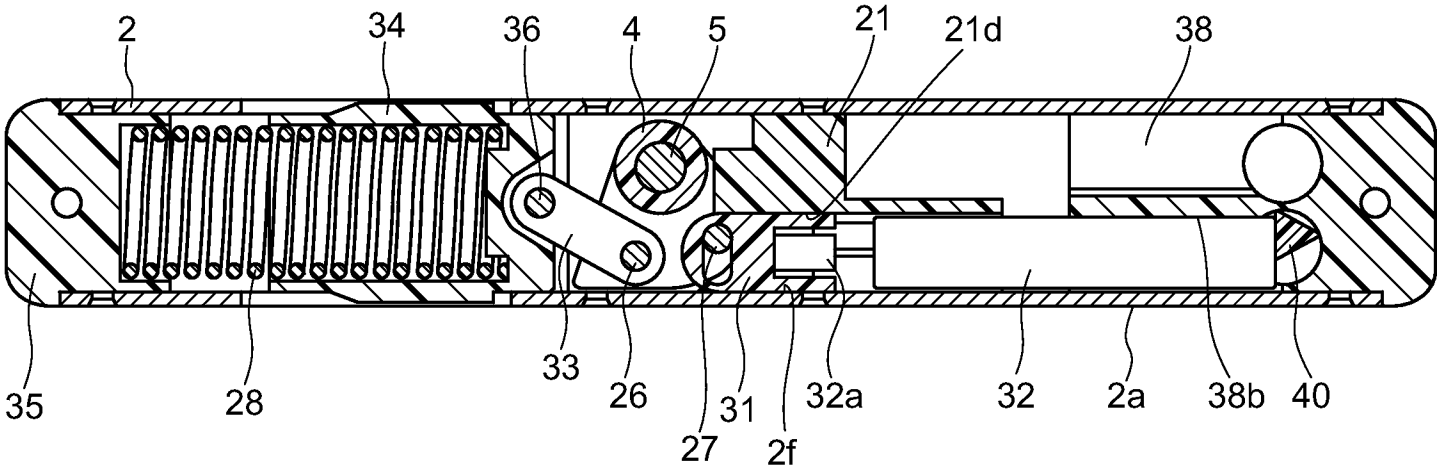
FIG. 7 is a cross sectional view of the door opening and closing device.

The retractable arm 4 rotates around the retractable arm axis 5. The first and second link shafts 26, 27 are inserted into the retractable arm 4 at off-center positions from the retractable arm axis 5. As illustrated in FIG. 7, the first link shaft 26 is always given a force of a coil spring 28 of the biasing mechanism 22. With this spring force of the coil spring 28, a force to retract the door d acts on the retractable arm 4. A slide block 31 of the damper mechanism 23 is connected to the second link shaft 27. When the retractable arm 4 is rotated in the closing direction, the slide block 31 pushes the heads of the rods 32*a* of the dampers 32. Therefore, if the retractable arm 4 tries to rotate in the closing direction quickly, the dampers 32 make the retractable arm 4 rotate slowly.

As illustrated in FIG. 6, the biasing mechanism 22 has the above-mentioned first link shaft 26, a link plate 33, a slide spring case 34, the coil spring 28 and a spring base 35.

In the retractable arm 4, a slit 4*a* is formed. While the link plate 33 is fit in the slit 4*a* in such a way as to sandwich the link plate 33, the first link shaft 26 is made to pass through the retractable arm 4 and the link plate 33 from above thereby to connect the link plate 33 to the retractable arm 4. At the other end of the link plate 33, a spring linking shaft 36 is fit therein. This spring linking shaft 36 is used to connect the slide spring case 34 to the link plate 33.

The slide spring case 34 is mounted in the body case 2 to be linearly movable. In a side surface of the slide spring case 34, a protrusion 34*a* is formed elongated linearly. In the body case 2, a slit 2*d* is formed for fitting the protrusion 34*a* therein. Linear movement of the slide spring case 34 relative to the body case 2 is guided by the slit 2*d* of the body case 2.

In the slide spring case 34, a hole is formed of which the diameter is slightly larger than the diameter of the coil spring 28. The coil spring 28 is inserted in this hole. At the opposite side of the coil spring 28 to the slide spring case 34, the spring base 35 is arranged. The spring base 35 has a hole of which diameter is slightly larger than the diameter of the coil spring 28. The coil spring 28 is compressed between the slide spring case 34 and the spring base 35. The spring base 35 is fixed to the end of the body case 2 by a rivet, screw or the like. In the spring base 35 and the body case 2, mounting holes 35*a*, 2*e* are formed for connecting the spring base 35 to the body case 2.

The damper mechanism 23 has the second link shaft 27, the slide block 31, dampers 23, a damper base 38 and a damper adjusting shaft 40.

In the retractable arm 4, a notch 4*b* is formed for insertion of the slide block 31. The slide block 31 is inserted into the notch 4*b* of the retractable arm 4 and the second link shaft 27 is made to pass through the retractable arm 4 and the slide block 31 from above, thereby connecting the slide block 31 to the retractable arm 4. In the slide block 31, a long hole 31*a* is formed in which the second link shaft 27 passes through. This is for the purpose of moving the slide block 31 linearly when the retractable arm 4 is rotated. As illustrated in FIG. 7, the head of the rod 32*a* of the damper 32 is inserted into the slide block 31. Linear movement of the slide block 31 is guided by the inner wall surface 2*f* of the body case 2 and the wall surface 21*d* of the arm base 21.

As illustrated in FIG. 6, the damper 32 used here is an extendable damper 32 having the rod 32*a* that moves relative to a main body part 32*b*. When the rod 32*a* contracts relative to the main body part 32*b*, a damping force is generated against the movement of the rod 32*a*. In this example, two, upper and lower, dampers 32 are used in combination.

At the end of the body case 2, the damper base 38 is connected thereto by a rivet, screw or the like. The damper base 38 and the body case 2 have mounting holes 38*a*, 2*g* for connecting the damper base 38 to the body case 2. The damper base 38 functions as a holding member for the dampers 32. In the damper base 38, the damper adjusting shaft 40 is mounted for adjusting the strength of the dampers 32. The damper adjusting shaft 40 abuts to the back parts of the dampers 32. The positions of the back parts of the two, upper and lower, dampers 32 can be adjusted by rotating the damper adjusting shaft 40. Out of three holes of the damper base 38, one 41*a* is a hole for mounting the door opening and closing device 1 to the door d. The other two, right and left, holes 41*b* are provided for insertion of the damper adjusting shaft 40. They are used to support the door d opening to both right and left sides. The direction in which the retractable arm 4 gets out of the body case 2 varies depending on the opening direction of the door d. In order to support both opening directions of the door d with one component only, the two holes 41*b* are formed. Further, in the damper base 38, recesses 38*b* are formed for storing the upper and lower dampers 32. These recesses 38*b* are provided two, corresponding to the two opening directions of the door d. Here, the position of the notch 3 of the body case 2 needs to change depending on the opening direction of the door d, however, this is satisfied by changing the bending direction of the thin plate and only one die of the thin plate is enough.

Figure 8A:
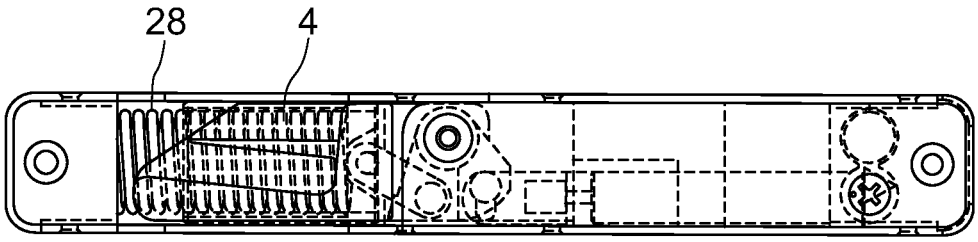
FIGS. 8(*a*) to 8(*c*) are operation diagrams of the door opening and closing device (FIG. 8(*a*) illustrates the retractable arm in the closed state, FIG. 8(*b*) illustrates the retractable arm in the half-open state and FIG. 8(*c*) illustrates the retractable arm in the open state)
Figure 8B:
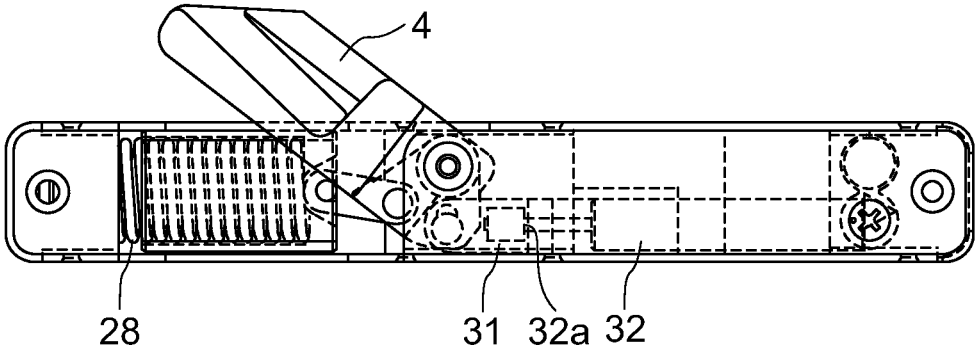
Figure 8C:
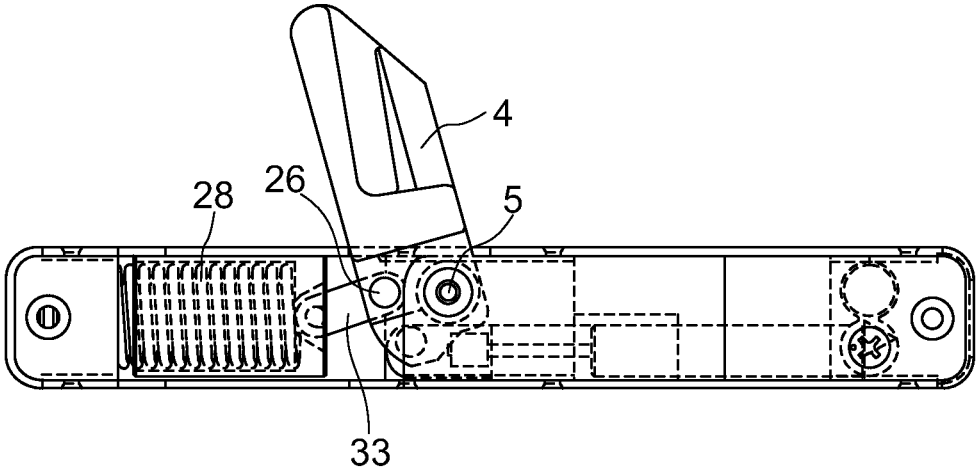

The door opening and closing device 1 operates as follows. The retractable arm 4 is rotated from the closed state as illustrated in FIG. 8(*a*) to the open state as illustrated in FIG. 8(*c*). When the retractable arm 4 is in the closed state, the retractable arm 4 is given an additional force to rotate in the closing direction by the spring force of the coil spring 28 of the biasing mechanism 22. When the retractable arm 4 is rotated in the opening direction against the spring force of the coil spring 28, it reaches the change point of the biasing mechanism 22. Then, the retractable arm 4 is further rotated in the opening direction and passed by the change point of the biasing mechanism 22. As illustrated in FIG. 8(*c*), a force to rotate the retractable arm 4 in the opening direction is generated by the spring force of the coil spring 28. Here, at the change point, the line connecting the retractable arm axis 5 to the first link shaft 26 coincides with the direction where the link plate 33 extends, and no force to rotate the retractable arm 4 is generated.

When the door d in the open state as illustrated in FIG. 8(*c*) is to be closed, the retractable arm is rotated in the counter-clockwise direction. As illustrated in FIG. 8(*b*), when passing the change point, the retractable arm 4 is given a force to rotate in the closing direction by the spring force of the coil spring 28. Accordingly, it becomes possible to close the door d automatically. Besides, as the retractable arm 4 rotates in the closing direction, the slide block 31 pushes the heads of the rods 32*a* of the dampers 32. Therefore, rotation of the retractable arm 4 can be made slow.

When the retractable arm 4 is rotated in the closing direction, the slide block 31 is made to abut to the heads of the rods 32*a* of the dampers 32 so that the dampers 32 can resist linear movement of the slide block 31. Meanwhile, when the retractable arm 4 is rotated in the opening direction, the slide block 31 goes away from the heads of the rods 32*a* of the dampers 32 so as not to resist the linear movement of the slide block 31. This is because no resistance is preferable for opening the door d. As illustrated in FIG. 7, the slide block 31 is not linked to the heads of the rods 32*a* of the dampers 32. The heads of the rods 32*a* are merely placed in the slide block 31. The arm base 21 and the body case 2 guide the slide block 31 and the dampers 32 so as to prevent play of the dampers 32 and the slide block 31 when the slide block 31 is away from the dampers 32.

The door opening and closing device 1 is assembled in the following manner. First, as illustrated in FIG. 6, the link plate 33 is inserted into the slit 4*a* of the retractable arm 4, the first link shaft 26 is inserted into the retractable arm 4 from above and the link plate 33 is linked to the retractable arm 4. Then, the slide block 31 is inserted into the notch 4*b* of the retractable arm 4, and the second link shaft 27 is inserted into the retractable arm 4 from above so that the slide block 31 is connected to the retractable arm 4. While the link plate 33 and the slide block 31 are connected to the retractable arm 4, the retractable arm 4 is sandwiched between the first and second wall parts 21*a*, 21*b* of the arm base 21 facing each other. Then, the arm axis 5 is inserted from below thereby to connect the retractable arm 4 to the arm base 21.

Then, while the retractable arm 4 and the arm base 21 are assembled, the arm base 21 is inserted into the body case 2. The retractable arm axis 5 is inserted into the ceiling part 2*a* of the body case 2, the end of the retractable arm axis 5 is fixed with a flat washer 43, and rivets are inserted into the mounting holes 2*c* and 21*c* of the body case 2 and the arm base 21 to rivet the arm base 21 to the body case 2.

Next, the spring linking shaft 36 is fit in the link plate 33, the slide spring case 34 is fit to the slit 2*d* of the body case 2 and the slide spring case 34 is connected to the spring linking shaft 36. When the coil spring 28 is inserted in the slide spring case 34, the spring base 35 is inserted via the opening 24*a* at the end of the body case 2, rivets are inserted into the mounting holes 2*e* and 35*a* of the body case 2 and the spring base 35 and the spring base 35 is riveted to the body case 2.

Next, the two dampers 32 are inserted into the arm base 21 via the opening 24*c* at the opposite end of the body case 2. The damper base 38 is fit into the body case 2, rivets are inserted into mounting holes 2*g* and 38*a* of the body case 2 and the damper base 38 and the damper base 38 is riveted to the body case 2.

Through these steps, assembly of all the parts is completed. As the retractable arm 4, the link plate 33 and the slide block 31 are assembled into the arm base 21 in advance and then, the arm base 21 is installed in the body case 2, the assembly work can be facilitated. It is only three parts, that is, the arm base 21, the spring case 35 and the damper base 38, that are connected to the body case 2.

Figure 9A:
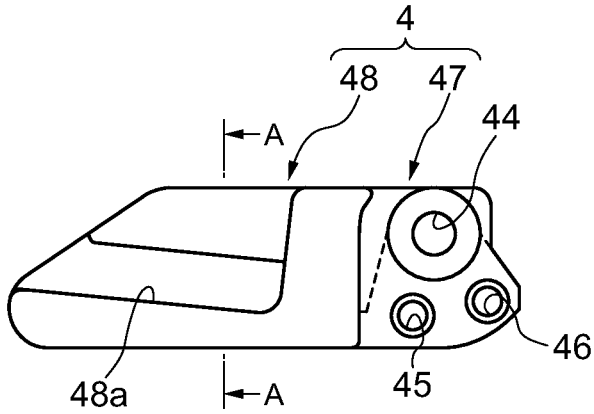
FIGS. 9(*a*) to 9(*c*) are detail views of the retractable arm (FIG. 9(*a*) is a plan view, FIG. 9(*b*) is a front view and FIG. 9(*c*) is a cross sectional view taken along the line A-A)
Figure 9B:
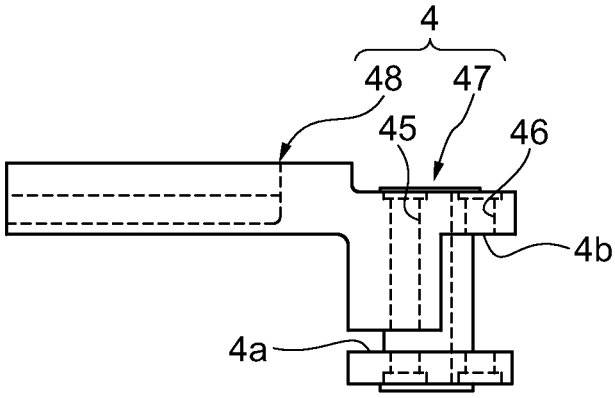
Figure 9C:
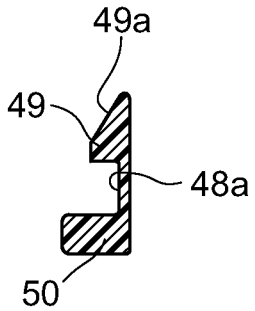
Figure 10A:
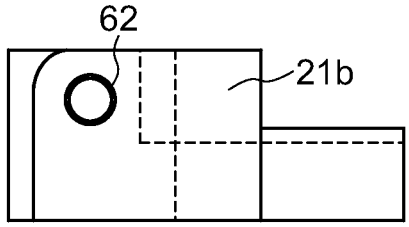
FIGS. 10(*a*) to 10(*d*) are detail views of the arm base (FIG. 10(*a*) is a plan view, FIG. 10(*b*) is a front view, FIG. 10(*c*) is a left side view and FIG. 10(*d*) is a right side view)
Figure 10B:
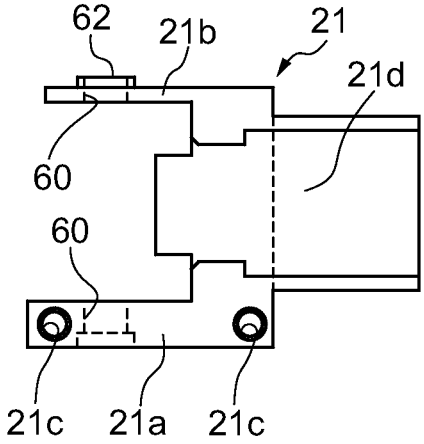
Figure 10C:
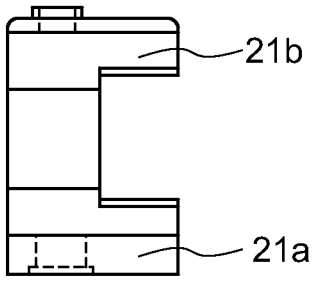
Figure 10D:
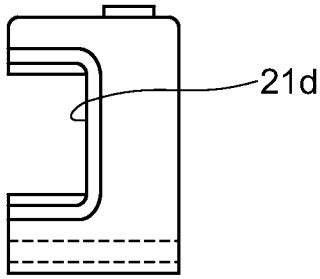

The detail structures of the retractable arm 4, the arm base 21 and the catch 8 are described below. FIGS. 9(*a*) to 9(*c*) are detail views of the retractable arm 4. The retractable arm 4 has a main body part 47 and an arm part 48. In the main body part 47, an arm axis hole 44 and two link shaft holes 45, 46 are formed. The arm part 48 extends horizontally from the upper end of the main body part 47. In the upper surface of the arm part 48, a groove part 48*a* is formed for inserting the catch shaft 12 of the catch 8. The groove part 48*a* extends from a midpoint of the arm part 48 to the tip end. As illustrated in the cross sectional view of FIG. 9(*c*), both-side wall parts 49, 50 of the groove 48*a* are different in height from each other (lengths in horizontal direction in the figure). When the retractable arm 4 is in the open state, the catch shaft 12 is inserted into the groove part 48*a* via an open end of the groove part 48*a*. Then, the catch shaft 12 abuts to the higher wall part 50 to rotate the retractable arm 4. With rotation of the retractable arm 4, the catch shaft 12 moves toward a closed end at the back of the groove part 48*a*. When the rotational angle of the retractable arm 4 passes the change point, the retractable arm 4 automatically rotates in the closing direction by the spring force of the coil spring 28 so that the lower wall part 49 of the groove part 48*a* abuts to the catch shaft 12. The retractable arm 4 rotates to the closed state with the wall part 49 in contact with the catch shaft 12. Then, the door becomes closed.

The catch shaft 12 can enter the groove part 48*a* at a midpoint of the groove part 48*a* of the arm part 48. As described in detail later, the catch shaft 12 is installed in the catch base 11 slidable in the axial direction (see FIGS. 11 and 12). When the retractable arm 4 is in the closed state, the catch shaft 12 abuts to the lower wall part 49 of the arm part 48, slides over the lower wall part 49 toward the catch base 11 and enters the groove part 48*a*. The lower wall part 49 has an inclined surface 49*a* for the catch shaft 12 to enter the groove part 48*a* easily.

The main body part 47 of the retractable arm 4 has the arm axis hole 44 for insertion of the retractable arm axis 5 and two link shaft holes 45, 46 at off-center positions from the arm axis hole. The first and second link shafts 26, 27 pass through the two link shaft holes 45, 46. In the main body part 47 of the retractable arm 4, the slit 4*a* is further formed for insertion of the link plate 33. This slit 4*a* is linked to the link shaft hole 45. In addition, in the main body part 47 of the retractable arm 4, the notch 4*b* is formed for insertion of the slide block 31. This notch 4*b* is coupled to the link shaft hole 46. The retractable arm 4 is manufactured by injection molding of resin.

FIGS. 10(*a*) to 10(*d*) are detail views of the arm base 21. The arm base 21 is of approximately U shape as a whole. The arm base 21 has a first wall part 21*a* for supporting the lower end of the retractable arm axis 5 and a second wall part 21*b* facing the first wall part 21*a* and provided for supporting the upper end of the retractable arm axis 5. The first wall part 21*a* and the second wall part 21*b* have holes 60 for inserting the retractable arm axis 5. The retractable arm 4 is sandwiched between the first wall part 21*a* and the second wall part 21*b* of the arm base 21 and the retractable arm axis 5 is made to pass through the arm base 21 and the retractable arm 4 from below. Then, the retractable arm 4 is connected to the arm base 21. As rotational movement of the retractable arm 4 is guided by the first and second wall parts 21*a*, 21*b* of the arm base 21, the retractable arm 4 can rotate in a stable manner. In a side surface of the first wall part 21*a* of the arm base 21, a mounting hole 21*c* is formed for connecting the arm base 21 to the body case 2. In the arm base 21, a wall surface 21*d* is formed for guiding the slide block 31 and the dampers 32.

In the upper surface of the second wall part 21*b*, a ring-shaped protrusion 62 is formed. When the body case 2 is inserted into the arm base 21, this ring-shaped protrusion 62 is fit in the hole of the ceiling part 2*a* of the body case 2. The upper surface of the second wall part 21*b* of the arm base 21 is in contact with the lower surface of the ceiling part 2*a* of the body case 2. The lower end of the retractable arm axis 5 is supported by the thick first wall part 21*a* and the upper end of the retractable arm axis 5 is supported by the ceiling part 2*a* of the body case 2 and the second wall part 21*b*. As the retractable arm axis 5 is supported at both ends, the support strength of the retractable arm axis 5 can be increased. As the upper end of the retractable arm axis 5 is supported by the ceiling part 2*a* of the body case 2 and the second wall part 21*b* of the arm base 21, the thickness of the second wall part 21*b* of the arm base 21 can be reduced, the height of the door opening and closing device 1 can be reduced, and the hole in the door upper surface can be made shallow. Besides, as the first and second wall parts 21*a*, 21*b* are provided in the arm base 21, it becomes easy to assemble the retractable arm 4 into the arm base 21. The arm base 21 is manufactured by injection molding of resin.

Here, the arm base 21 has only to support at least one end of the retractable arm axis 5. For example, the second wall part 21*b* of the arm base 21 may be omitted and the retractable arm axis 5 may be supported between the first wall part 21*a* of the arm base 21 and the ceiling part 2*a* of the body case 2. Besides, the retractable arm axis 5 may be supported only between the first wall part 21*a* and the second wall part 21*b* of the arm base 21 and not by the ceiling part 2*a* of the body case 2.

Figure 11:
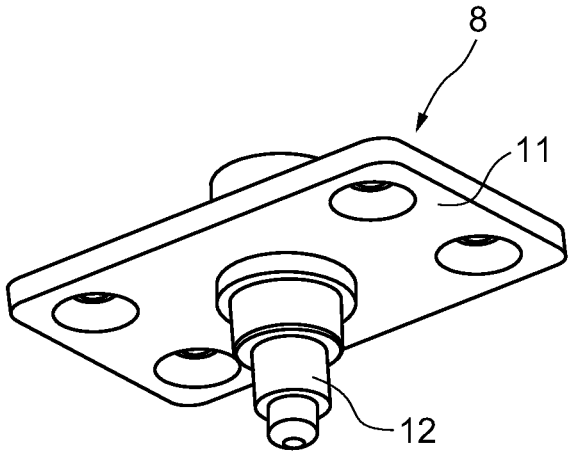
FIG. 11 is a perspective view of the catch.
Figure 12:
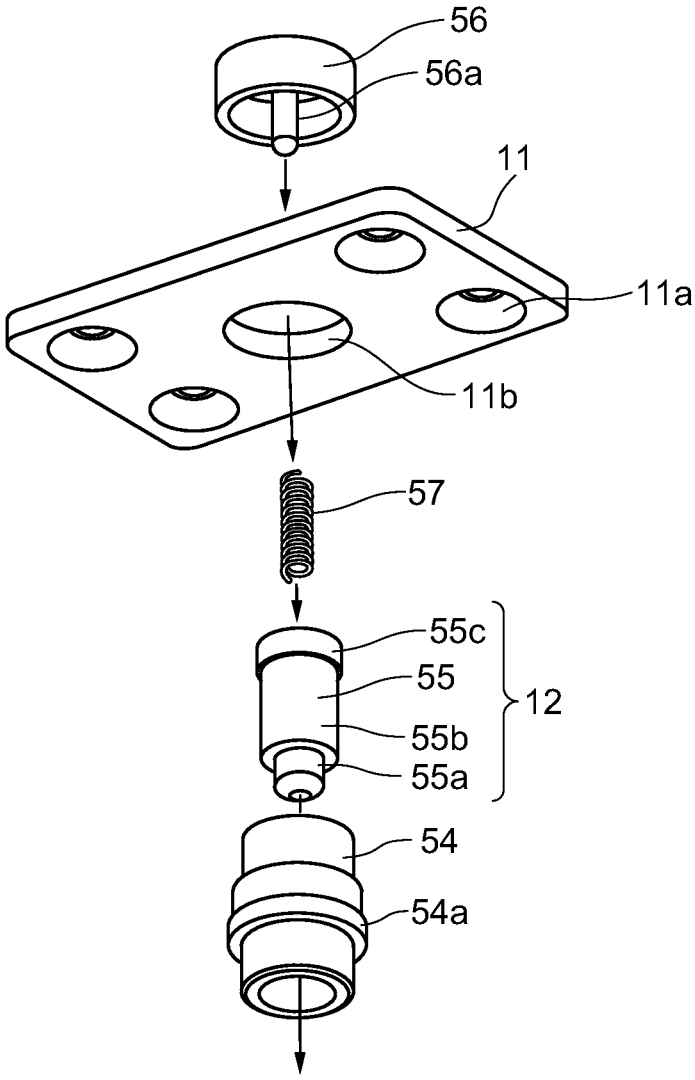
FIG. 12 is an exploded perspective view of the catch.

FIGS. 11 and 12 are detail views of the catch 8. FIG. 11 is a perspective view of the catch 8 and FIG. 12 is an exploded perspective view of the catch 8. The catch 8 has the catch base 11 mounted on the frame f and the catch shaft 12 projecting from the catch base 11. The retractable arm 4 of the door opening and closing device 1 catches the catch shaft 12 of the catch 8 to open and close the door d.

As illustrated in FIG. 12, the catch base 11 is formed into a rectangle. At four corners of the catch base 11, four countersunk screw-mounting holes 11*a* are formed. At a center hole 11*b* of the catch base 11, a catch outer shaft 54 for guiding the catch shaft 12 to slide in the axial direction is fit therein to be connected integrally. The catch outer shaft 54 takes a hollow-cylindrical shape. On the outer peripheral surface of the catch outer shaft 54, a flange 54*a* is formed, and the catch outer shaft 54 is pushed into the hole 11*b* of the catch base 11 until the flange 54*a* abuts to the catch base 11. On the catch outer shaft 54, a back cover 56 is connected thereto from the back surface side of the catch base 11. The back cover 56 is provided to support the coil spring 57 as an elastic member. In the back cover 56, a support bar 56*a* is formed, which is fit in the center of the catch spring 57 to support the catch spring 57.

In the catch outer shaft 54, a catch shaft 55 is fit. The catch shaft 55 is of an approximately cylindrical shape and is enclosed at a tip end. At the tip end of the catch shaft 55, a cylindrical small-diameter part is formed as a step part. The catch shaft 55 has the small-diameter part 55*a* and a main body part 55*b*. The main body part 55*b* is supported slidable by the catch outer shaft 54. The small-diameter part 55*a* is formed to be concentric with the main body part 55*b* and have the diameter smaller than the diameter of the main body part 55*b*. With these small-diameter part 55*a* and main body part 55*b*, step difference is provided at the tip end of the catch shaft 55. The catch spring 57 is inserted into the main body part 55*b* of the catch shaft 55. The catch spring 57 is placed between the catch shaft 55 and the back cover 56 to make the catch shaft 55 jut from the catch outer shaft 54. The catch shaft 55 is made to jut from the catch outer shaft 54 until the flange 55*c* of the catch shaft 55 abuts to the step difference in the inner peripheral surface of the catch outer shaft 54. Needless to say, the catch shaft 55 may be pushed into the catch outer shaft 54 against the spring force of the catch spring 57.

Figure 13A:
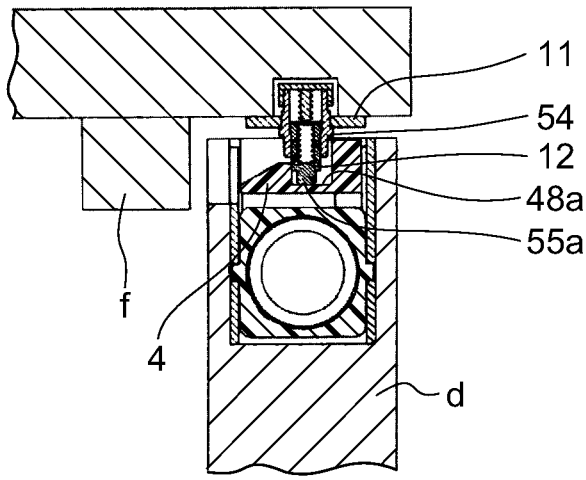
FIGS. 13(*a*) and 13(*b*) are views illustrating the relationship between the catch and the retractable arm (FIG. 13(*a*) illustrates the catch shaft fit in the groove part of the retractable arm and FIG. 13(*b*) illustrates a small-diameter part of the catch shaft fit in the groove part of the retractable arm)
Figure 13B:
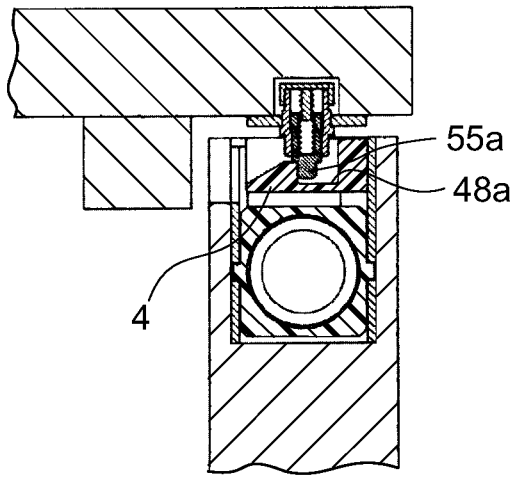

As illustrated in FIG. 13(*a*), when the door d is closed, in order to prevent rattling of the door d, the retractable arm 4 of the door opening and closing device 1 catches the catch shaft 12 to give an additional force in the closing direction, even if the door d comes into contact with the frame f. That is, when the door d is closed, the retractable arm 4, itself, is not rotated to the completely closed state and the rotational angle of the retractable arm 4 is just before the closed-state rotational angle. There still remains room for the retractable arm 4 to rotate in the closing direction.

If the retractable arm 4 in the open state is brought into the closed state unnecessarily, in error, the retractable arm 4 is rotated to the completely closed state. In this case, if the door d is tried to be closed into the return state where the catch shaft 12 is fit in the groove part 48*a* of the retractable arm 4, the catch shaft 12 cannot be fit in the groove part 48*a* of the retractable arm 4. As illustrated in FIG. 13(*b*), as the small-diameter part 55*a* is formed at the tip end of the catch shaft 12, if the retractable arm 4 is rotated to the completely closed state, the small-diameter part 55*a* can be caught in the groove part 48*a* of the retractable arm 4 by a difference of diameter between the main body part 55*b* and the small-diameter part 55*a*. When the small-diameter part 55*a* of the catch shaft 12 can be caught in the groove part 48*a* of the retractable arm 4, the retractable arm 4 can be rotated to the open state, and in next use, the catch shaft 12 will be able to be caught in the groove part 48*a* of the retractable arm 4 so that the door opening and closing device can be used in a normal way. As the outer peripheral surface of the small-diameter part 55*a* is formed cylindrical and is not tapered, the small-diameter part 55*a* caught in the groove part 48*a* of the retractable arm 4 is prevented from being retracted in the catch outer shaft 54 and getting out of the groove part 48*a*.

Figure 14:
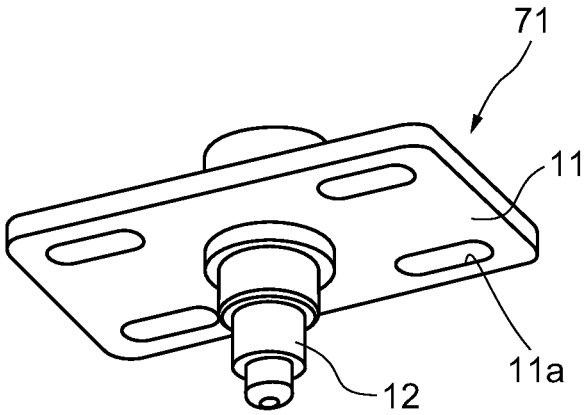
FIG. 14 is a perspective view of another example of the catch.
Figure 15:
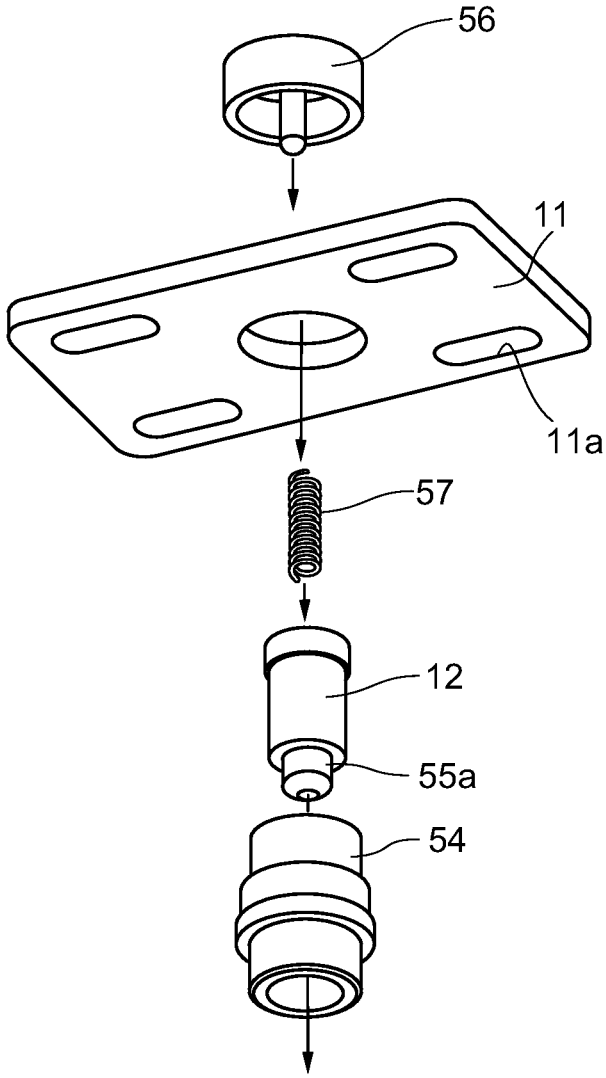
FIG. 15 is an exploded perspective view of another example of the catch.

FIGS. 14 and 15 illustrate another example of the catch. The catch 71 of this example has a catch base 11, a catch outer shaft 54, a catch shaft 12, a coil spring 57 and a back cover 56. The catch shaft 12 is installed in the catch outer shaft 5 to be slidable in the axial direction. As the structures of the catch outer shaft 54, the catch shaft 12, the coil spring 57 and the back cover 56 are the same as those illustrated in FIGS. 11 and 12, these are denoted by the like reference numerals and description thereof is omitted here.

In the catch of this example, four mounting holes 11*a* of the catch base 11 are formed long. This is for adjusting the position of the catch shaft 12 relative to the frame f. The position of the catch shaft 12 can be adjusted in such a manner that the small-diameter part 55*a* of the catch shaft 12 can be sure to be fit in the groove part 48*a* of the retractable arm 4 even if the retractable arm 4 is rotated to the completely closed state.

Figure 16:
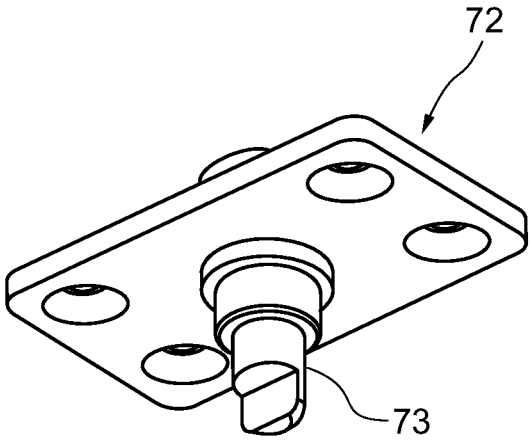
FIG. 16 is a perspective view of yet another example of the catch.
Figure 17:
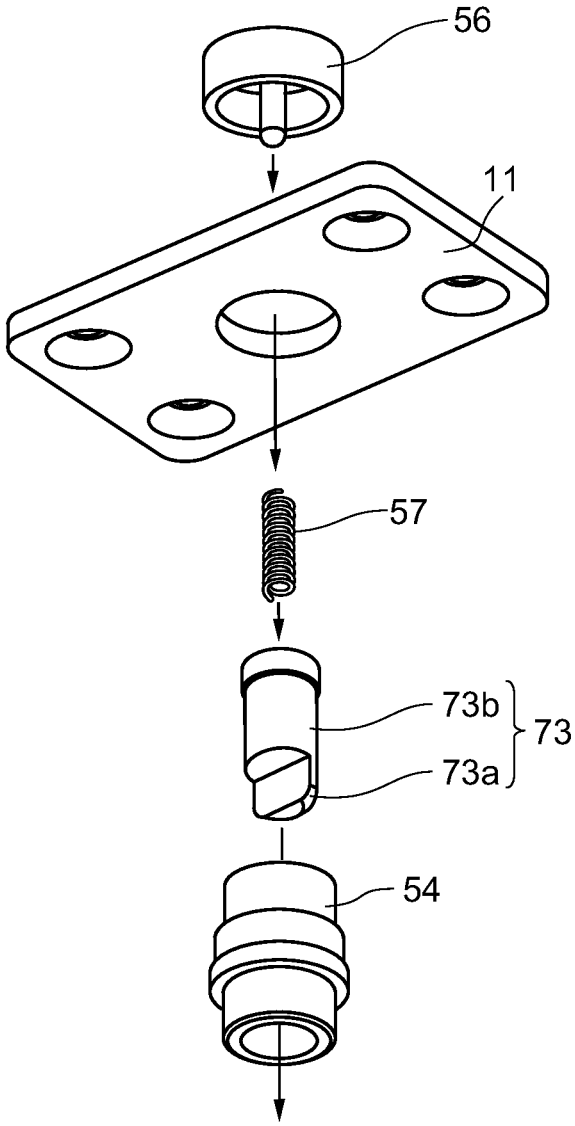
FIG. 17 is an exploded perspective view of yet another example of the catch.

FIGS. 16 and 17 illustrate yet another example of the catch. The catch 72 of this example is different from the catch 8 illustrated in FIGS. 11 and 12 in the structure of the catch shaft 73. As the structures of the catch base 11, catch outer shaft 54, the coil spring 57 and the back cover 56 are the same as those of the catch 8 illustrated in FIGS. 11 and 12, these are denoted by the like reference numerals and description thereof is omitted here. In the catch 72 of this example, a tip end of a cylindrical main body part 73*b* of the catch shaft 73 is cut off into a semi-circular cylindrical step part 73*a*. As illustrated in this example, the step part can be provided halfway around the catch shaft 73, though in the catch 8 illustrated in FIGS. 11 and 12, the step part is provided on the entire circumference of the catch shaft 12. However, there needs to be provided means for preventing the catch shaft 73 from rotating relative to the catch outer shaft 54.

Here, the present invention is not limited to the above-described embodiments and may be embodied in various forms without departing from the scope of the present invention.

For example, the door opening and closing system according to the present embodiment is not limited to the construction door and can be applied to assist opening and closing of not only a construction sliding door, furniture door, sliding door and drawer. Besides, the cross sectional shapes of the small-diameter part and the main body part of the catch shaft are not limited to round and may be polygon such as quadrangular.

The present specification is based on Japanese Patent Applications No. 2009-191100 filed on Aug. 20, 2009, the entire contents of which are expressly incorporated by reference herein.

REFERENCE NUMERALS

1 . . . door opening and closing device
4 . . . retractable arm
5 . . . retractable arm axis (arm axis)
8, 71, 72 . . . catch
11 . . . catch base
11*a* . . . long hole
12,73 . . . catch shaft
55*a* . . . small-diameter part (step part)
55*b*, 73*b* . . . main body part
57 . . . coil spring (elastic member)
73*a* . . . step part

The invention claimed is:

1. A door opening and closing system comprising:

a catch which is mounted at either one of a door and a frame; and a door opening and closing device which is mounted on an opposite one of the door and the frame and has a retractable arm that is engaged with the catch, in which, when the door gets closed, the retractable arm of the door opening and closing device is engaged with the catch and the retractable arm rotates about an arm axis to give the door a force in a closing direction, wherein the catch has a catch base which is mounted on the one of the door and the frame and a catch shaft which is installed in the catch base slidable in an axial direction and engaged with the retractable arm, the catch shaft has a main body part which is engageable with the retractable arm and a step part which is provided at a tip end of the main body part by hollowing at least a part of the main body part in a circumferential direction and engageable with the retractable arm, and the step part of the catch shaft and the retractable arm are engaged with each other in a state where the retractable arm is rotated more in the closing direction than in a state where the main body part of the catch shaft and the retractable arm are engaged with each other.

2. The door opening and closing system of claim 1, wherein the step part is provided on an entire circumference of the catch shaft.

3. The door opening and closing system of claim 2, wherein the catch base has a slot formed therein for adjusting a mounting position of the catch base relative to the door or the frame.

4. The door opening and closing system of claim 1, wherein the catch base has a slot formed therein for adjusting a mounting position of the catch base relative to the door or the frame.

5. The door opening and closing system according to claim 1, wherein the step part has a smaller diameter than the main body part, and the step part is concentric with the main body part.

6. The door opening and closing system according to claim 1, wherein a catch spring is inserted between the main body part and a back cover so as to make the catch shaft jut from a catch outer shaft.

7. The door opening and closing system according to claim 6, wherein the catch shaft is adapted to jut from the catch outer shaft until a flange of the catch shaft abuts to a step difference in an inner peripheral surface of the catch outer shaft.

8. A door opening and closing system comprising:

a catch which is mounted at either one of a door and a frame; and a door opening and closing device which is mounted on an opposite one of the door and the frame and has a retractable arm that is engaged with the catch, in which, when the door gets closed, the retractable arm of the door opening and closing device is engaged with the catch and the retractable arm rotates about an arm axis to give the door a force in a closing direction, wherein the catch has a catch base which is mounted on the one of the door and the frame and a catch shaft which is installed in the catch base slidable in an axial direction and engaged with the retractable arm, the catch shaft has a main body part which is engageable with the retractable arm and a step part which is provided at a tip end of the main body part and smaller in diameter than the main body part, and the step part of the catch shaft and the retractable arm are engaged with each other in a state where the retractable arm is more rotated in the closing direction than in a state where the main body part of the catch shaft and the retractable arm are engaged with each other.

9. The door opening and closing system according to claim 8, wherein the step part has a smaller diameter than the main body part, and the step part is concentric with the main body part.

10. The door opening and closing system according to claim 8, wherein a catch spring is inserted between the main body part and a back cover so as to make the catch shaft jut from a catch outer shaft.

11. The door opening and closing system according to claim 10, wherein the catch shaft is adapted to jut from the catch outer shaft until a flange of the catch shaft abuts to a step difference in an inner peripheral surface of the catch outer shaft.

12. A catch for a door opening and closing system which gives a door a force in a closing direction when the door gets closed, wherein the catch has a catch base which is mounted on either one of the door and a frame and a catch shaft which is installed in the catch base slidable in an axial direction and engaged with a retractable arm, the catch shaft has a main body part which is engageable with the retractable arm and a step part which is provided at a tip end of the main body part and smaller in diameter than the main body part, and the step part of the catch shaft and the retractable arm are engaged with each other in a state where the retractable arm is more rotated in the closing direction than in a state where the main body part of the catch shaft and the retractable arm are engaged with each other.

13. The door opening and closing system according to claim 12, wherein the step part has a smaller diameter than the main body part, and the step part is concentric with the main body part.

14. The door opening and closing system according to claim 12, wherein a catch spring is inserted between the main body part and a back cover so as to make the catch shaft jut from a catch outer shaft.

15. The door opening and closing system according to claim 14, wherein the catch shaft is adapted to jut from the catch outer shaft until a flange of the catch shaft abuts to a step difference in an inner peripheral surface of the catch outer shaft.

* * * * *